United States Patent [19]

Northcutt

[11] 4,443,881

[45] Apr. 17, 1984

[54] SUSPENSION SYSTEM FOR ELECTRIC HEATING ELEMENTS

[76] Inventor: Donald R. Northcutt, 7345 Brittany, Shawnee Mission, Kans. 66203

[21] Appl. No.: 383,478

[22] Filed: Jun. 1, 1982

[51] Int. Cl.[3] ..... F27D 11/02; H05B 3/06

[52] U.S. Cl. ..... 373/130; 373/137

[58] Field of Search ..... 373/130, 137, 128, 134, 373/119

[56] References Cited

U.S. PATENT DOCUMENTS 4,011,394 3/1977 Shelley ..... 373/137

4,272,638 6/1981 Cimochowski ..... 373/130

*Primary Examiner*—Roy Envall

*Attorney, Agent, or Firm*—D. A. N. Chase; Michael Yakimo, Jr.

[57] ABSTRACT

A suspension system for an electric heating element array of a furnace comprises first and second suspension arms with a hanger element support member extended therebetween. The suspension arms are pivotally mounted to a support rod passing through the insulation module and linked to the furnace wall via the module attachment system. Upon affixation of the insulation module to the furnace wall the suspension arms are pivoted until the support member contiguously transverses the hot face of the module. A plurality of hanger elements are suspended from the support member with the heating elements then hung therefrom.

15 Claims, 4 Drawing Figures

SUSPENSION SYSTEM FOR ELECTRIC HEATING ELEMENTS

BACKGROUND OF THE INVENTION

This invention relates to apparatus for supporting electric heating elements in a furnace, and more particularly to a suspension system designed for cooperation with the wall attachment system of the insulation module in a manner to provide a positive and rigid suspension of the electric heating elements.

Electric industrial furnaces utilize a serpentine array of resistance heating elements for significantly raising the temperature within the furnace working chamber. These heating elements are used in conjunction with a plurality of insulating modules attached to a furnace wall. Once these insulation modules or blocks are attached, the heating elements must then be positioned adjacent the "hot face" of the associated module to provide their temperature raising function.

Many devices have been utilized to support this serpentine arrangement of the electric resistance heating elements. Previous apparatus for supporting these heating elements have included the use of dense material in the insulation module itself to support the hanger elements or required the hanger support elements to be attached directly to the furnace outer wall.

More particularly one hanger system utilizes an elongated plate inserted between the fibrous batts or pleats of an insulation module so as to be in an "anchoring" relationship with the adjacent material batts. From this anchor plate, a plurality of rod members extend through the module in a direction away from the furnace wall and into the central chamber of the furnace proper. Ceramic spools are attached to the free end of each rod, which is adjacent the module's hot face, from which is suspended the array of serpentine electric heating elements.

Another type of apparatus embeds an elongated anchor member within the insulation module itself. A S-shaped hook member then pierces the insulation module so as to engage this material supported anchor member. The opposed end of the hook member protrudes inwardly into the central cavity of the furnace to allow suspension of the electric heating elements therefrom.

A more recent apparatus involves a stud-like support member which extends from an insulated cylindrical holder fixed to the furnace wall. Once the insulation module is in place a stud bolt is extended through the module to engage the cylindrical holder with the free end of the stud bolt protruding into the central cavity to allow for suspension of the hanger elements therefrom.

Although the above apparatus have been found to be generally effective in their operation a tradeoff arises in their use between the respective advantages of a rigid attachment to the furnace wall or the affixation of the heating element members' support to the fibrous module itself. In the former, the make ready time prior to wall affixation of the fibrous modules is increased which in turn increases the time and expense of module installation. Those devices which utilize an anchoring relationship of the heating element support member with the module material must forego the rigidity provided by interaction of the support member with the furnace wall itself.

Accordingly, I provide a suspension system which provides a rigid support for the suspended heating element array without the need to attach the system directly to the furnace wall and without the need to establish an anchoring relationship with the material of the insulation module itself.

In my preferred embodiment, I utilize an insulated fibrous module manufactured from an accordion-pleated refractory fibrous blanket. Each module is supported by two spaced-apart rods that pass through the module at right angles to the module pleats. An elongated metal channel is linked to these support rods via an intervening channel bracket member. This channel engages a protruding disc member previously shot or otherwise attached to the furnace wall. This attachment system is made and licensed by the Mansville Products Corporation and provides a lightweight insulation module easily affixed to the furnace wall.

In connection with such an attachment system, I provide a pair of laterally spaced-apart, elongated suspension arm members, positioned between adjacent material pleats, which are pivotally connected to both of the support rods preferrably during the manufacture of the insulation module. Attached between the spaced-apart free ends of the suspension arms and to the exterior of the module is a cross bar to present a yoke-like member for suspension of hanger elements therefrom. Once the insulation module is attached to the wall, the suspension arms or yokes are swung to position each suspension cross bar, in a vertically spaced-apart relationship, across the "hot" face of each module. Hanger elements are then releasably attached to the upper cross bar member with the serpentine arrangement of heating elements then suspended therefrom. Retaining hooks are attached to the lower cross bar member and to the lower portion of the heating elements to preclude lateral shifting of the heating elements along the cross bars.

I have found that the linking connection of my suspension system with the above described mechanical attachment system presents a sturdy and effective suspension system for the heating elements that does not interfere with module installation or with the integrity of the insulating material itself.

Accordingly it is a general object of this invention to provide a suspension system for electric furnace heating elements which cooperates with the associated attachment system so as to present a sturdy and rigid support for the array of heating elements hung therefrom.

Another object of this invention is to provide a suspension system, as aforesaid, which facilitates the positioning and replacement of the electric heating elements without interference from or damage to the associated insulation module.

Still another object of this invention is to provide a suspension system, as aforesaid, which will not interfere with the integrity of the fibrous module itself.

Another object of this invention is to provide a suspension system, as aforesaid, which utilizes a pair of suspension arms and an associated suspension cross brace therebetween to present a yoke-like member swingable into a functional position subsequent to the installation of the insulation module.

Another object of this invention is to provide a suspension system, as aforesaid, which utilizes a linking relationship to the associated mechanical connection system.

Other objects and advantages of this invention will become apparent from the following description taken in connection with the accompanying drawings, wherein is set forth by way of illustration and example an embodiment of this invention.

DESCRIPTION OF THE PREFERRED EMBODIMENT

Figure 4:
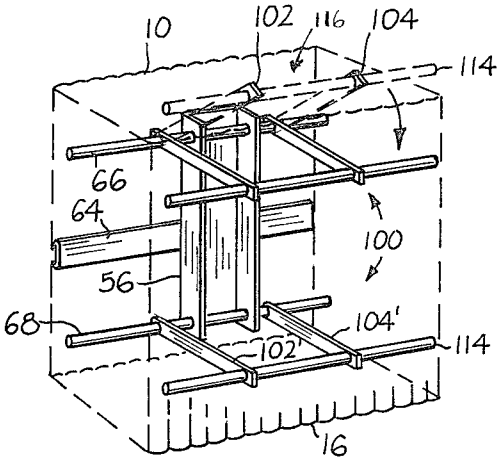
FIG. 4 is a perspective view, on a reduced scale, illustrating the swingable movement of the yoke-like configuration of the suspension arms and cross brace member relative to the phantom outline of the associated insulation module.
Figure 1:
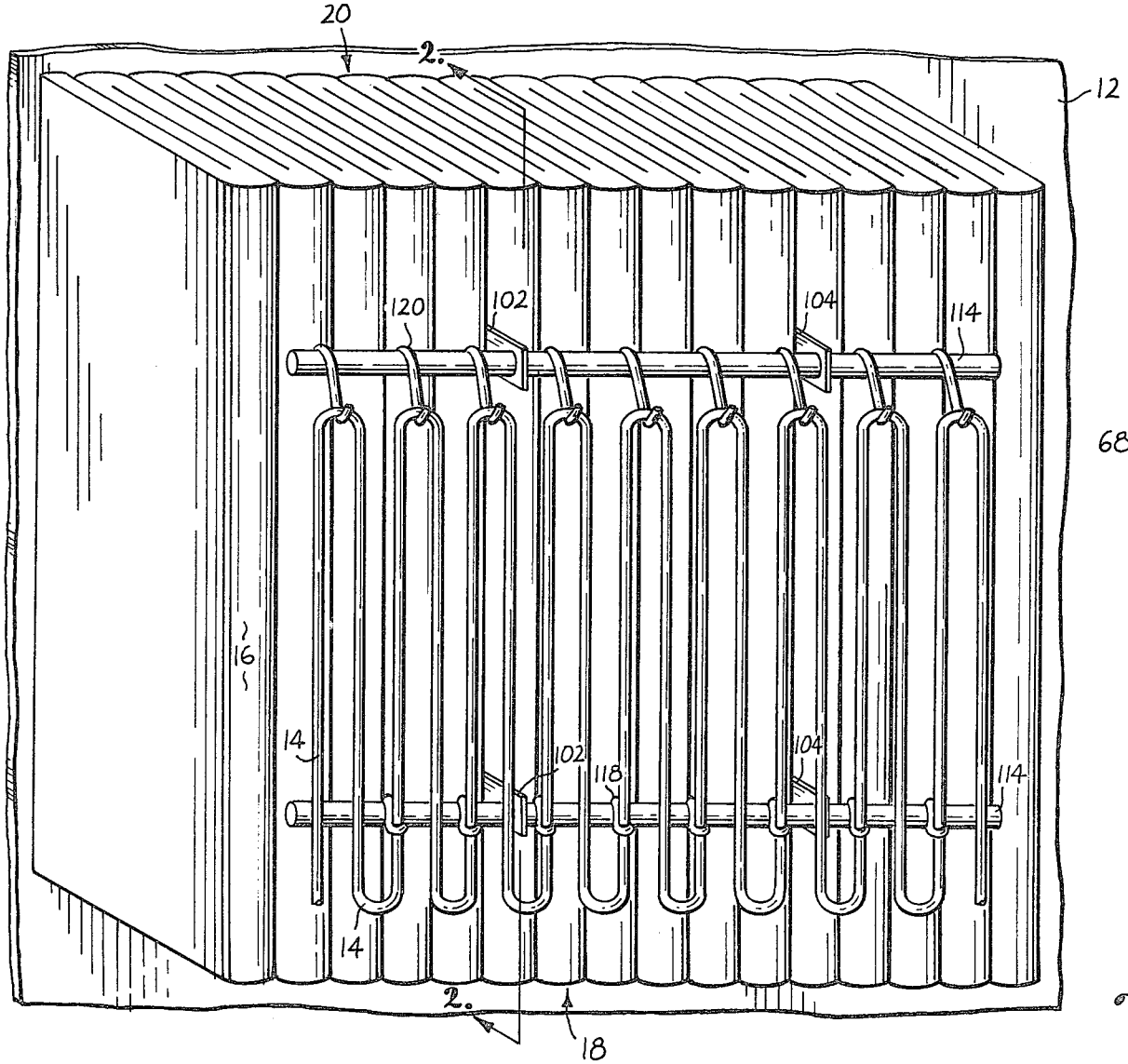
FIG. 1 is a perspective view of an insulation module attached to a furnace wall with the suspension system in place and the heating elements hung therefrom.

Turning more particularly to the drawings, FIG. 1 shows an insulation module 10 attached to a furnace wall 12 by means of a mechanical connection system 50. Cooperating with this connection system 50 is my suspension assembly 100 from which the serpentine array of heating elements 14 are hung therefrom.

The insulation block 10 may be made from a refractory fiber known in the industry as CERAWOOL, CERABLANKET, CERACHROME or similar materials such material being designed for use in furnaces or kilns.

The blanket is folded in accordion fashion into a number of pleats 16 with the module 10 density being a function of the pre-pleated blanket density and number of pleats 16 in the module 10. Thus, the modules 10 are custom fabricated according to the design requirements and operating temperatures of the particular furnace installation.

The connection system 50 includes a stud 52 having a disc member 54 at one end thereof. The stud 52 is shot or otherwise embedded into the furnace wall 12 so as to allow the disc 54 to be in a slightly spaced-apart relationship therefrom.

Associated with each block 10 during manufacture is a channel support member 56 having laterally spaced-apart side walls 58 and 60 with an end wall 62 spanning therebetween. Each side wall 58, 60 extends through the adjacent pleats 16 of the module 10 from the cold face 20 of the module and toward the hot face 18 thereof. It is understood that the cold face 20 of the module is that face adjacent the furnace wall 12 with the hot face 18 being disposed adjacent the central working chamber or cavity of the furnace.

Attached to the end wall 62 of the channel support member 56 is an elongated channel 64 in lateral extension across the cold face 20. The channel 64 is C-shaped in configuration so as to provide a race for slidably engaging the disc member 54 therein.

Extending through the side walls 58 and 60 in a normally disposed relationship thereto are lower and upright support rods 66 and 68 which extend normally through the pleats 16. These support rods 66 and 68 are adjacent the cold face 20 of the module 10 and support the fibrous material of the insulation block 10 to offer rigidity and stability thereto.

During manufacture of insulation module 10 with the connection system 50 incorporated therein, the insulating material is compressed with the hot face 18 and sides of the block 10 being encompassed by fiber board with tension bands wound therearound (not shown). The unit 10 is then affixed to the furnace wall by the above-described channel member 64/disc 54 engagement. Once positioned, the tension bands are then cut with the fiber board removed allowing for expansion of the previously compressed insulation material. It is understood that this process is repeated along the furnace wall 12 to provide a complete wall of the insulating material blocks 10 thereon.

Turning more particularly to my suspension assembly 100 I utilize in each assembly a pair of elongated, planar suspension arms 102, 104 preferably made of a ceramic material. The elongated, planar configuration allows for extension of the respective suspension arms 102, 104 between the adjacent accordion pleats 16 of the associated insulation block.

Each arm 102, 104 has a support rod connecting end 106 with aperture 108 therein and a longitudinally spaced-apart free end 110 with free end aperture 112 therein. Each pair of suspension arms 102, 104 is fastened to the respective support rods 66, 68 by rod/aperture engagement preferably during incorporation of the connection system 50 into the insulation block 10 as above-described. My now preferred embodiment utilizes a pivotal connection of the arms 102, 104 to both the lower and upper support rods 66, 68.

Upon affixation of the plurality of insulation blocks 10 to the furnace wall 12, as above-described, the suspension arms 102, 104 are pivoted through a vertically disposed arc relative to the support rod 66, 68 and between the pleats 16 to a position as shown in FIG. 1. This swingable movement positions the free end 110 of each arm 102, 104 beyond the "hot" face 18 of the insulation block 10 and into the central cavity of the furnace.

Figure 2:
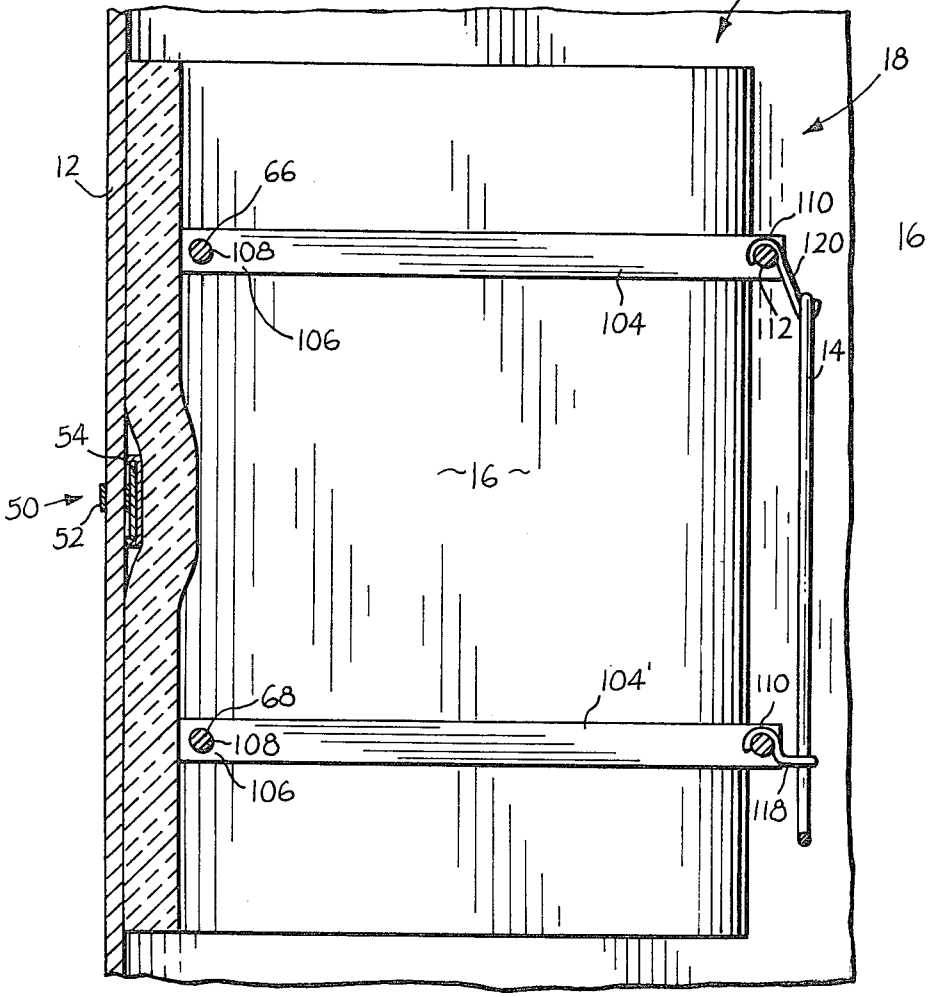
FIG. 2 is a sectional view taken along line 2—2 in FIG. 1 and showing the interior cooperation of the suspension arms with the attachment system of the insulation module.

A ceramic suspension cross bar member 114 is extended through the free end apertures 112 so as to transverse the "hot" face 18 of the block 10 as can be seen in FIG. 1. This suspension arm 102, 104/cross bar 114 relationship presents a yoke-like configuration 116. It is understood that the suspension cross bar 114 can be earlier connected to the arms 102, 104 so that the entire yoke 116 is pivotally mounted to the appropriate support rod 66, 68. Referring to FIGS. 1 and 2, the suspension cross bar 114 contacts the "hot" face 18 of the block 10 which delimits the swingable movement of the suspension arms 102, 104. Thus, it is understood that the length of the respective suspension arms 102, 104 can determine the terminal position of the swingable arms relative to the associated support rods 66, 68 and thus the position of the cross bar 114 relative to the hot face 18 of the block 10.

Figure 3:
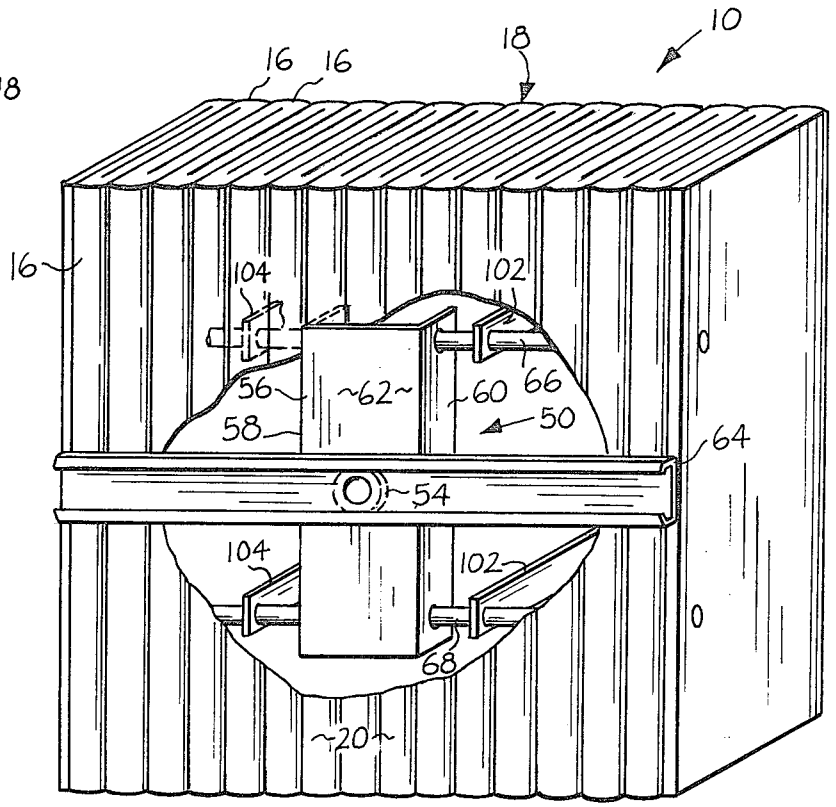
FIG. 3 is a rear view of the insulation module of FIG. 1, on a reduced scale, with a portion of the rear surface of the insulation module broken away to show the system elements embedded therein.

Once the cross bar 114 is in position, as shown in FIG. 3, hook members 120 are hung/supported from the upper cross bar member 114 from which are hung the heating elements 14. It can be seen in FIG. 2 that the suspension cross bars 114 bear against the "hot" face 18 of the block to space the heating elements 14 therefrom so as to prevent undesirable contact between the heating elements 14 and hot face 18. Also, as shown in FIG. 1 a retainer hook member 118 is connected to the lower support rod 114' and to the lower portions of the heating element 14 passing across the lower cross bar member 114'. These hooks 118 preclude lateral shifting of the heating elements 14 that may arise during the changes in their temperature.

Accordingly, I have established, via module support members 66 or 68, a relationship between the wall connection system 50 of the insulation block 10 and my suspension system 100. Utilization of suspension arms 102 and 104, as positioned between the adjacent modules pleats 16, provides for a swinging movement of the free ends 110 of these arms into the central cavity of the furnace. These suspension arms cooperate with the spanning cross bar member 114, to provide for a yoke-like support of the hooks 120 and heating elements 14 hung therefrom.

Thus, I have established a rigid suspension system 100 without the need for direct affixation to the furnace wall 12 or for direct anchoring cooperation with the insulation module itself.

Although I have now set forth my suspension assembly 100 in connection with an accordion-pleated block 10, it is, understood that it is also adaptable for use with monolithic or vacuum formed insulation blocks.

Accordingly, it is to be understood that while certain forms of this invention have been illustrated and described, it is not limited thereto, except in so far as such limitations are included in the following claims.

Having thus described the invention, what is claimed as new and desired to be secured by Letters Patent is:

1. For use with an attachment system for affixing an insulation module to a furnace wall with said attachment system having at least one module support member therein, a suspension system for supporting a furnace heating element array adjacent the hot face of said module comprising:

first and second laterally spaced-apart suspension arms each having first and second longitudinally spaced-apart ends therein;

means for pivotally mounting said suspension arm first ends to said module support member in a manner to preclude interference by said module with said pivotal movement;

a cross bar member;

means for mounting said cross bar member between said second ends of said suspension arms, said cross bar member transversing said hot face of said module upon pivotal movement of said suspension arms and concurrent movement of said second ends of said suspension arms to a position adjacent said hot face; and at least one hanger element engageable with said cross bar member for suspending said heating elements therefrom in said position adjacent said hot face of said module.

2. The apparatus as claimed in claim 1, with said insulation module being of an accordion-like configuration to present a plurality of adjacent material pleats therein wherein each suspension arm is positioned between adjacent pleats to preclude said interference with said module during said arm pivotal movement.

3. The apparatus as claimed in claims 1 or 2, wherein said cross bar member contacts said hot face of said module to delimit said pivotal movement of said suspension arms.

4. The apparatus as claimed in claim 1, wherein the length of said suspension arms are selectable to determine the position of said cross bar member along the extent of said hot face of said module.

5. The apparatus as claimed in claim 1, wherein said hanger elements cooperate with said cross bar member to suspend said heating elements away from said hot face to preclude harmful heat transfer therebetween.

6. The apparatus as claimed in claim 1, wherein said suspension arms are releasably mounted to said module support member.

7. The apparatus as claimed in claim 1, further comprising:

at least a third suspension arm member having first and second opposed ends therein;

means for pivotally mounting said first end of said third suspension arm member to a module support member in a manner to preclude interference of said module with said third suspension arm member during said pivotal movement;

a second cross bar member;

means for mounting said second cross bar member to the second end of said at least third suspension arm member with said pivotal movement of said third suspension arm positioning said second cross bar member below said other cross bar member and in a position transversing said hot face of said module, said second cross bar member contacting the lower portion of said suspended heating element array to preclude interference of said lower portion of said heating elements with said adjacent insulation module.

8. The apparatus as claimed in claim 7, further comprising at least one retainer element on said lower second cross bar member and engageable with said heating element member to preclude lateral shifting of said heating element during operation thereof.

9. For use with an attachment system for affixing an insulation module to a furnace wall, a suspension system for positioing furnace heating elements adjacent to hot face of said module comprising;

a support rod extending through said module;

means for joining said support rod with said attachment system;

at least one suspension arm having first and second longitudinally space-apart ends;

means for pivotally connecting said first end of each suspension arm to said support rod at a position providing for swingable movement of each suspension arm and concurrent movement of said second end of each suspension arm to a position forwardly adjacent said hot face;

a suspension cross bar member associated with the second end of each suspension arm and in swingable movement therewith to a position transversing the hot face of said module; and hanger means engaging said cross bar member for suspension of said heating elements therefrom.

10. For use with an attachment system for affixing an, accordion-pleated, insulation module to a furnace wall, a suspension system for furnace heating elements comprising;

a support rod extending through said pleats;

means for linking said support rod with said furnace wall;

at least one suspension arm having first and second longitudinally spaced-apart ends;

means for pivotally connecting the first end of each suspension arm to said support rod at a position providing for swingable arm movement between the pleats of said module;

a suspension cross bar;

means for connecting said cross bar to said second end of each suspension arm and in swingable movement therewith for transversal of said cross bar across the hot face of said module upon completion of said swingable arm movement; and hanger means engageable with said cross bar for hanging said heating elements therefrom.

11. For use with an attachment system for affixing an insulation module to a furnace wall with said system having a module support member therein, a suspension system for supporting a furnace heating element array adjacent the hot face of said module comprising:

at least one suspension arm with each arm having first and second longitudinally spaced-apart ends therein;

means for pivotally mounting each suspension arm first end to said support member in a manner to preclude interference by said module with said pivotal movement;

a hanger element support member;

means for mounting said hanger element support member to said second end of said suspension arm in pivotal movement therewith and to a position forwardly adjacent said hot face of said module; and at least one hanger element engageable with said hanger element support member for suspending said heating elements therefrom in said position adjacent said hot face of said module.

12. A method of suspending electric heating elements adjacent the hot face of an insulation module affixed to the wall of a furnace comprising the steps of:

(a) providing an attachment system for affixing said module to the wall of said furnace;

(b) inserting a module support member in said module;

(c) linking said module support member to said attachment system;

(d) providing a hanger element support member therein;

(e) pivotally linking a hanger element support member to said module support member in a manner to preclude interference of said hanger element support member with said module;

(f) utilizing said attachment system to affix said module to said wall;

(g) pivoting said hanger element support member to a position transversing said hot face of said module;

(h) engaging a hanger element to said hanger element support member; and (i) suspending said heating element from said hanger element to a position adjacent said hot face.

13. The method as claimed in claim 12, wherein said step of pivoting said hanger element support member includes contacting said hot face with said support member.

14. The method as claimed in claim 12, wherein said pivotally linking step comprises the steps of:

providing an arm member having first and second opposed ends;

pivotally connecting said arm member first end to said module support member; and mounting said hanger element support memter to said arm member second end.

15. For use with an attachment system for affixing an insulation module to a furnace wall, a suspension system for supporting a furnace heating element array adjacent the hot face of said module comprising:

at least one suspension arm having first and second longitudinally spaced-apart ends therein;

means for linking said suspension arm first end to said attachment system in a manner to position said second end of each suspension arm adjacent said hot face of said module;

at least one hanger element support member;

means for associating a hanger element support member with said second end of said suspension arm, said support member transversing said hot face of said module; and at least one hanger element engageable with said hanger element support member for suspending said heating elements therefrom in said position adjacent said hot face of said module.

* * * * *

UNITED STATES PATENT AND TRADEMARK OFFICE

CERTIFICATE OF CORRECTION

PATENT NO. : 4,443,881

DATED : April 17, 1984

INVENTOR(S) : DONALD R. NORTHCUTT

It is certified that error appears in the above—identified patent and that said Letters Patent is hereby corrected as shown below:

Column 6, Claim 9, line 34, change "positioing" to --positioning--.

Column 7, Claim 12(e), line 41, change "a" to --said--.

Column 8, Claim 14, line 21, change "memter" to --member--.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*